US009056456B2

(12) United States Patent
Marumoto et al.

(10) Patent No.: US 9,056,456 B2
(45) Date of Patent: Jun. 16, 2015

(54) RECORDING APPARATUS AND RECORDING METHOD

(71) Applicant: CANON KABUSHIKI KAISHA, Tokyo (JP)

(72) Inventors: Yoshitomo Marumoto, Kawasaki (JP); Hiromitsu Yamaguchi, Yokohama (JP); Hitoshi Tsuboi, Kawasaki (JP); Ryota Kato, Yokohama (JP); Takayuki Ushiyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/531,565

(22) Filed: Nov. 3, 2014

(65) Prior Publication Data

US 2015/0124014 A1 May 7, 2015

(30) Foreign Application Priority Data

Nov. 5, 2013 (JP) ..... 2013-229750

(51) Int. Cl.
*B41J 29/38* (2006.01)
*B41J 2/045* (2006.01)

(52) U.S. Cl.
CPC ..... *B41J 2/04501* (2013.01)

(58) Field of Classification Search
CPC .... B41J 2/04505; B41J 2/04573; B41J 2/155; B41J 2/2132; B41J 29/393
USPC ..... 347/9–12, 14, 15, 40
See application file for complete search history.

(56) References Cited

U.S. PATENT DOCUMENTS

| | | | | |
|---|---|---|---|---|
| 7,222,927 | B2 * | 5/2007 | Eguchi et al. | 347/12 |
| 7,513,584 | B2 * | 4/2009 | Kuwahara et al. | 347/5 |
| 8,752,927 | B2 * | 6/2014 | Takahashi et al. | 347/12 |
| 2004/0218200 | A1 | 11/2004 | Ebihara | |

* cited by examiner

*Primary Examiner* — An Do
(74) *Attorney, Agent, or Firm* — Canon USA, Inc. IP Division

(57) ABSTRACT

A recording apparatus that continuously vary a first boundary formed by different discharge port arrays in an area on a recording medium corresponding to a first overlap portion, and a second boundary formed by different discharge port arrays on an area of the recording medium corresponding to a second overlap portion close to the first overlap portion, wherein a shape of the variation of the first boundary and a shape of the variation of the second boundary are different from each other.

26 Claims, 12 Drawing Sheets

RECORDING APPARATUS AND RECORDING METHOD

BACKGROUND OF THE INVENTION

1. Field of the Invention

One disclosed aspect of the embodiments relates to a recording apparatus and a recording method.

2. Description of the Related Art

A recording apparatus that completes an image on a recording medium by discharging inks onto the recording medium while scanning a recording head including a plurality of discharge port arrays corresponding to the different inks, each port array having a plurality of discharge ports for discharging inks having the same color arranged in a predetermined direction and intersecting the arrangement direction of the discharge ports, has conventionally been known.

In the above-mentioned recording apparatus, an improvement in recording speed has been required in recent years, and the recording head has been lengthened in keeping with the requirement for the improvement. As means for lengthening the recording head, portions (hereinafter referred to as overlap portions) capable of recording the same pixel row on the recording medium from predetermined numbers of discharge ports arranged at ends of the two discharge port arrays, which are adjacent in the arrangement direction of the discharge ports for discharging the same inks are provided. Thus, a recording head (hereinafter referred to as a joint head) is configured to have a plurality of discharge port arrays sequentially arranged therein along the arrangement direction of the discharge ports. The recording head can be lengthened by arranging a plurality of short discharge port arrays when the joint head is used.

When an image is recorded using the joint head, unevenness may occur in an image area on the recording medium recorded by the discharge ports arranged in the overlap portion, causing deterioration in the quality of the image. The unevenness includes unevenness caused by an error in mounting of the discharge port arrays and an error in manufacture of the discharge ports and unevenness caused by different timings for discharging inks from the respective discharge ports arranged in the discharge port arrays which constitutes the overlap portion.

United States Patent Publication Application No. 2004/0218200 discusses the technique which regularly varies in an arrangement direction a boundary between an area where recording is performed only by discharge from discharge ports in one of two discharge port arrays constituting an overlap portion in a joint head, and an area where recording is performed only by discharge ports in another discharge port array, as the boundary moves in a scanning direction. As a consequence, unevenness occurring in an area on a recording medium corresponding to the overlap portion in the joint head becomes inconspicuous. Further, United States Patent Publication Application No. 2004/0218200 also discusses the technique in which, when a plurality of joint heads discharging different inks, is arranged in the scanning direction, shapes of respective boundaries in overlap portions in the joint heads are formed different from each other.

However, in recent years, a demand to improve an image quality of a recording image has increased. In a method discussed in United States Patent Publication Application No. 2004/0218200, a sufficient image quality may be unable to be obtained.

Such an issue will be described in detail below.

FIG. 1 illustrates an image recorded on a recording medium according to a conventional technique using a joint head.

For simplicity, a joint head is used in which six discharge port arrays 22 are configured to have 50 discharge ports 30 arranged in a Y direction. while The three discharge ports 30 arranged at one end of one of the discharge port arrays 22 and the three discharge ports 30 arranged at the other end of the other one of the discharge port arrays 22 form an overlap portion 65 to record an image in the same area 68 on a recording medium 3. The discharge port arrays 22 are shifted in a predetermined direction to have a staggered shape.

The joint head 7 performs discharge from each of the discharge ports 30 arranged in the single discharge port array 22 onto an area 67 of the recording medium 3 corresponding to an area 66 other than the overlap portion 65. On the other hand, the discharge ports 30 respectively arranged in the two discharge port arrays 22 forming the overlap portion 65 share the area 68 on the recording medium 3 corresponding to the overlap portion 65 in discharging inks.

According to a method discussed in United States Patent Publication Application No. 2004/0218200, when recording is performed on a recording medium 3 using the above-mentioned joint head 7, ink discharge is controlled so that in an area 68*a* on the recording medium 3 corresponding to an overlap portion 65*a* of discharge port arrays 22*a* and 22*b*, a boundary 69*a* of dots formed by discharge from discharge ports in the discharge port array 22*a* and dots formed by discharge from discharge ports in the discharge port array 22*b* continuously vary, as illustrated in FIG. 1.

Further, in areas 68*b*, 68*c*, 68*d*, and 68*e* on the recording medium 3 respectively corresponding to overlap portions 65*b*, 65*c*, and 65*d*, and 65*e*, boundaries 69*b*, 69*c*, 69*d*, and 69*e* of dots corresponding to one discharge port array and the other discharge port array are also formed while continuously varying, so as to have similar patterns.

However, if a plurality of boundaries corresponding to a plurality of overlap portions in the joint head 7 is arranged in the same shape in the Y direction, as illustrated in FIG. 1, variation patterns 67*a*, 67*b*, 67*c*, 67*d*, and 67*e* of the boundaries mutually emphasize each other on the entire recorded image, and the boundaries are easily recognized as an visual image. Thus, when the entire image is viewed, unevenness occurring in the overlap portions in the joint head 7 may be sufficiently suppressed, causing deterioration in the quality of the image.

SUMMARY OF THE INVENTION

One disclosed aspect of the embodiments is directed to providing a recording apparatus and a recording method for inhibiting variation patterns of boundaries in a recorded image from mutually emphasizing in each other a plurality of overlap portions and making unevenness of the image inconspicuous.

According to an aspect of the embodiments, a recording apparatus that records an image includes a recording head including at least first, second, and third discharge port arrays each having a plurality of discharge ports for discharging inks having the same color arranged in a predetermined direction, the first, second, and third discharge port arrays being displaced from one another in the predetermined direction so that the N number of first discharge ports arranged at an end on the first side in the predetermined direction of the first discharge port array and the N number of second discharge ports arranged at an end on the second side opposite to the first side in the predetermined direction of the second discharge port array are arranged in a direction intersecting the predetermined direction to form a first overlap portion for discharging the inks to the same area on a recording medium, and the N number of third discharge ports arranged at an end on the first side in the predetermined direction of the second discharge port array and the N number of fourth discharge ports arranged at an end on the second side in the predetermined direction of the third discharge port array are arranged in the intersecting direction to form a second overlap portion for discharging the inks to the same area on the recording medium, and a control unit configured to perform control to discharge the inks to the recording medium from the recording head according to recording ratios respectively determined for the N number of first discharge ports, the N number of second discharge ports, the N number of third discharge ports, and the N number of fourth discharge ports while relatively scanning in the intersecting direction of the recording head and the recording medium, in which the control unit controls the discharge of the inks in each of pixel columns including a plurality of pixels arranged in the predetermined direction on the recording medium so that (i) the inks are not discharged, among the N number of first discharge ports, from the M ($0 \leq M \leq N$) number of discharge ports on the first side in the predetermined direction and are discharged according to the first recording ratio from the L ($0 \leq L \leq N-M$) number of discharge ports on the second side in the predetermined direction, (ii) the inks are not discharged, among the N number of second discharge ports, from the L number of discharge ports on the second side in the predetermined direction and are discharged according to the first recording ratio from the M number of discharge ports on the first side in the predetermined direction, (iii) the inks are not discharged, among the N number of third discharge ports, from the K ($0 \leq K \leq N$) number of discharge ports on the first side in the predetermined direction and are discharged according to the second recording ratio from the J ($0 \leq J \leq N-K$) number of discharge ports on the second side in the predetermined direction, and (iv) the inks are not discharged, among the N number of fourth discharge ports, from the J number of discharge ports on the second side in the predetermined direction and are discharged according to the second recording ratio from the K number of discharge ports on the first side in the predetermined direction, and in which respective values in at least one of a first set of the M and the K and a second set of the L and the J continuously increase or decrease as a position of the pixel column in the intersecting direction on the recording medium changes, and the respective values differ from each other when the position of the pixel column in the intersecting direction on the recording medium is a predetermined position.

Further features of the disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings.

A first exemplary embodiment will be described in detail below.

Figure 1:
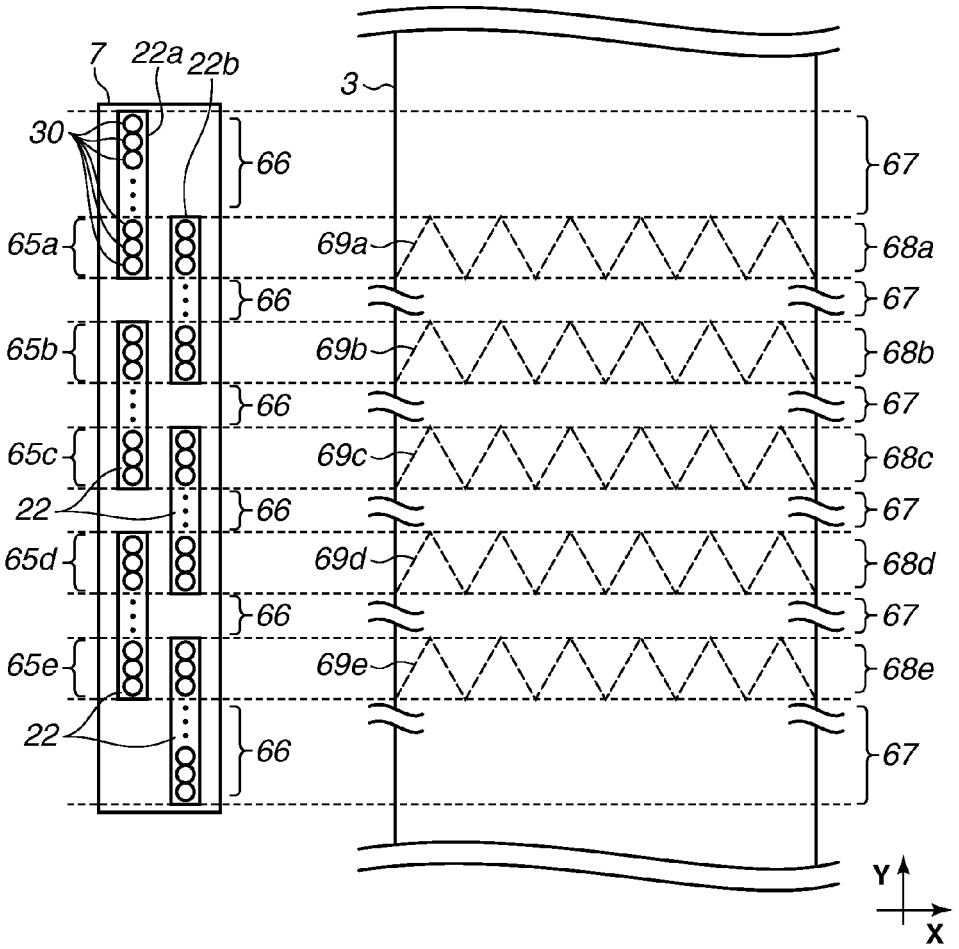
FIG. 1 is a diagram for illustrating how recording is performed on a recording medium using a joint head.
Figure 2:
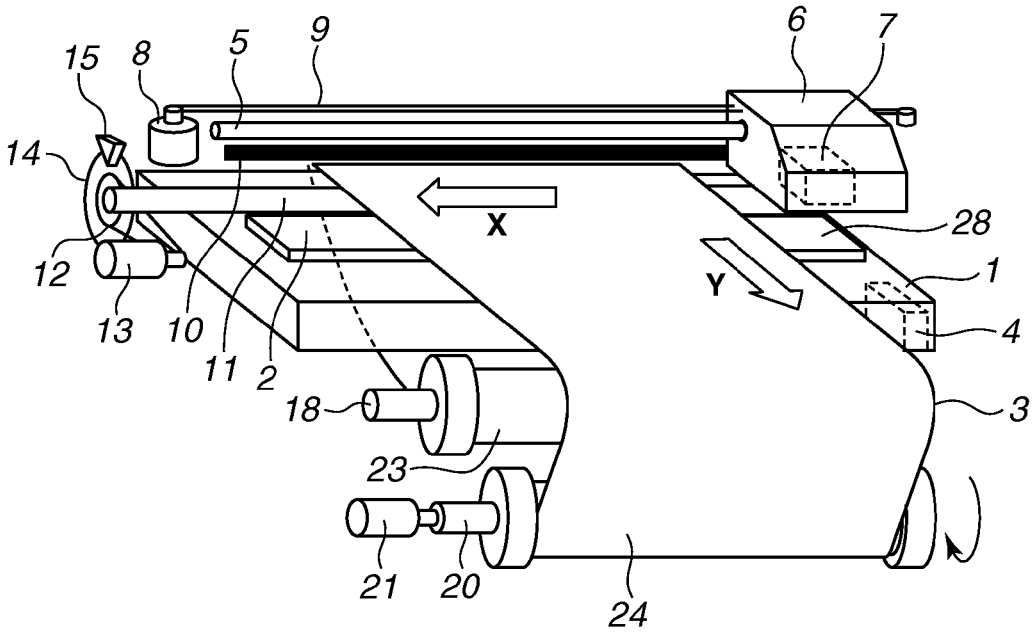
FIG. 2 is a perspective view of a recording apparatus according to an exemplary embodiment.
Figure 3:
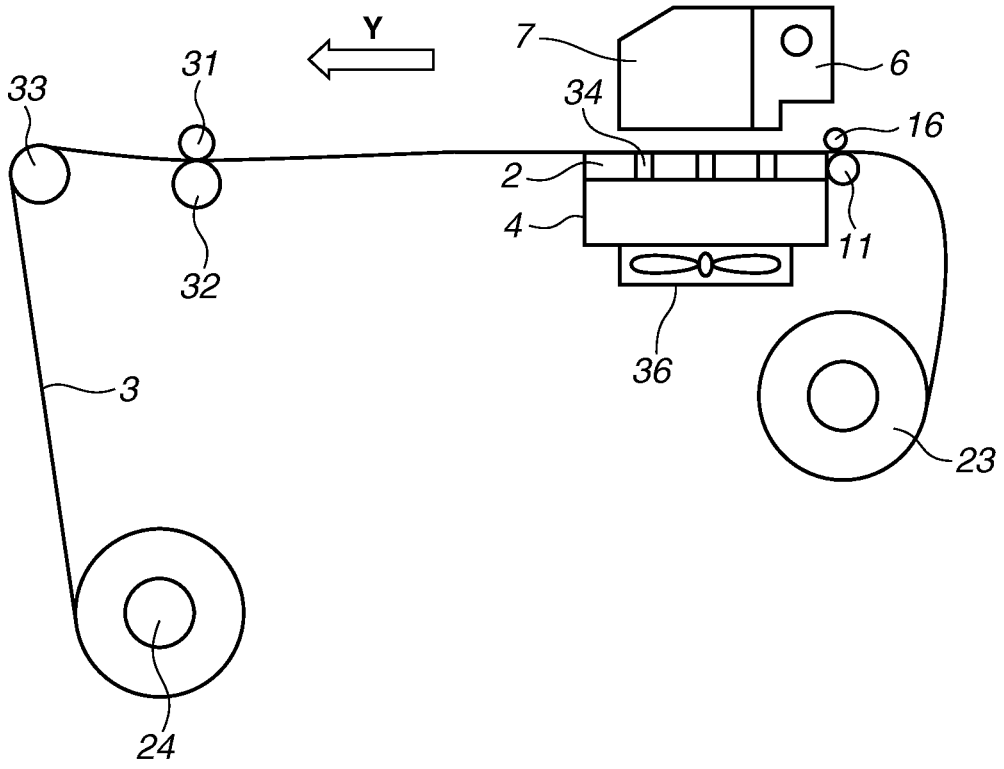
FIG. 3 is a side view illustrating a configuration of the inside of the recording apparatus according to the exemplary embodiment.

FIG. 2 is a perspective view partially illustrating a configuration of the inside of a recording apparatus according to an exemplary embodiment. FIG. 3 is a side view partially illustrating the configuration of the inside of the recording apparatus according to the exemplary embodiment.

A platen 2 is arranged inside the recording apparatus. The platen 2 has many suction holes 34 formed therein to adsorb a recording medium 3 onto the platen 2 to prevent the recording medium 3 from floating. The suction holds 34 are joined to a duct, and a suction fan 36 is further arranged on the bottom of the duct. The suction fan 36 operates to make the recording medium 3 adhere onto the platen 2.

A carriage 6 is supported on a main rail 5 extending in a sheet width direction, and can reciprocate in an X direction. The carriage 6 is loaded with an inkjet joint head 7, described below. Various recording types such as a thermal jet type using a heating element and a piezoelectric type using a piezoelectric element can be applied to the joint head 7. A carriage motor 8 is a drive source for moving the carriage 6 in the X direction, and its rotation driving force is transmitted to the carriage 6 by a belt 9.

The recording medium 3 is fed being wound off from a medium 23 wound in a roll shape. The recording medium 3 is conveyed in a Y direction (conveyance direction) intersecting the X direction on the platen 2. The recording medium 3 has its leading edge pinched between a pinch roller 16 and a conveyance roller 11, and is conveyed when the conveyance roller 11 is driven. The recording medium 3 is pinched between a roller 31 and a sheet discharge roller 32 on the downstream side in the Y direction of the platen 2, and is further wound around a take-up roller 24 via a turn roller 33.

FIG. 4 illustrates the joint head 7 used in the present exemplary embodiment.

Figure 4A:
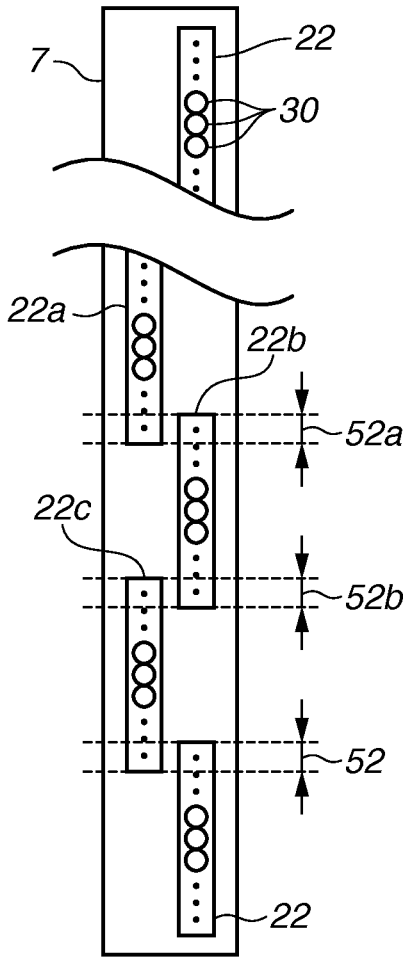
FIGS. 4A and 4B illustrate a configuration of a joint head applied in the exemplary embodiment.
Figure 4B:
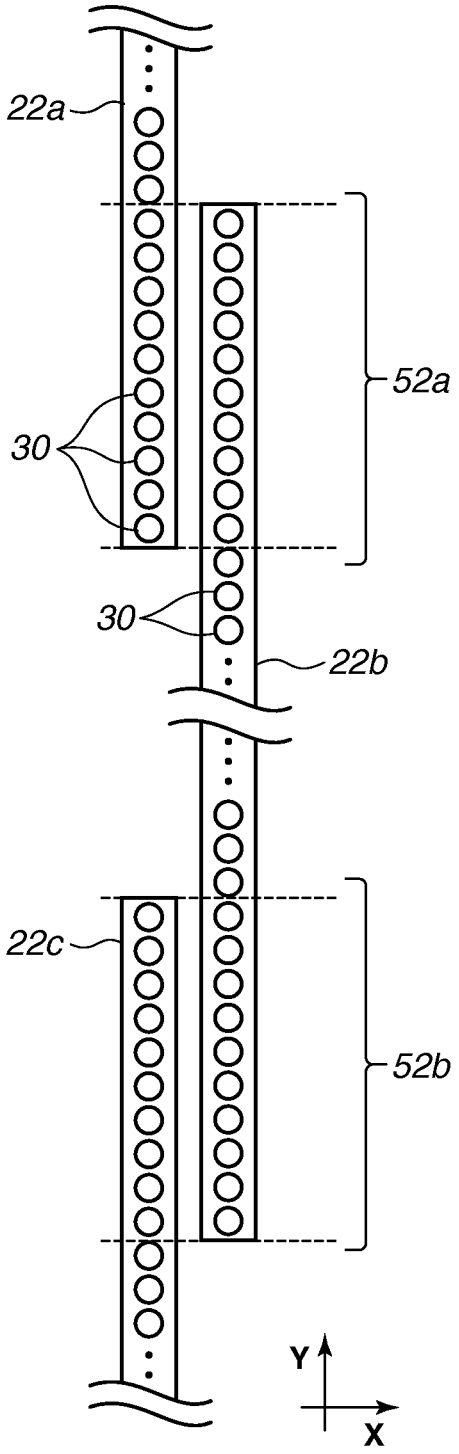

FIG. 4A illustrates the entire joint head 7 used in the present exemplary embodiment. FIG. 4B is an enlarged view for illustrating details of overlap portions in the joint head 7 used in the present exemplary embodiment.

The joint head 7 in the present exemplary embodiment includes 18 discharge port arrays 22 configured by arranging 1280 discharge ports 30 for discharging inks having the same color in a Y direction (predetermined direction) at a density of 1200 dpi. In the joint head 7, the plurality of discharge port arrays 22 is arranged in a staggered shape in the Y direction while the two discharge port arrays at positions in close proximity to each other in the Y direction respectively have the 10 discharge ports 30 arranged at their ends in an X direction to form an overlap portion 52 capable of discharging the inks onto the same area of the recording medium 3.

For simplicity, among the 18 discharge port arrays 22, the three discharge port arrays 22, i.e., the discharge port array 22*a*, the discharge port array 22*b* adjacent to the discharge port array 22*a* on the upstream side thereof in the Y direction, and the discharge port array 22*c* adjacent to the discharge port array 22*b* on the upstream side in the Y direction will be described below. Thus, among the 17 overlap portions 52, the overlap portion 52*a* formed by the discharge port array 22*a* and the discharge port array 22*b* and the overlap portion 52*b* formed by the discharge port array 22*b* and the discharge port array 22*c* will be described below.

Referring to FIGS. 2 and 3 again, in the recording apparatus configured as described above, the recording medium 3 is conveyed in the Y direction from a conveyance unit (not illustrated). The joint head 7 receives a recording signal from a recording control unit (not illustrated), and discharges inks toward a recording area of the recording medium 3 while the joint head 7, together with the carriage 6, is relatively scanning in an X direction (intersecting direction) to form dots on the recording medium 3. In the present exemplary embodiment, recording is performed on a unit area of the recording medium 3 by performing scanning once. Therefore, the inks are discharged to all pixels within the unit area by performing scanning once.

After the joint head 7 is scanned, the recording medium 3 is conveyed by an amount corresponding to the length of the joint head 7 toward the downstream side in the Y direction. After the conveyance, the joint head 7 scans a unit area adjacent to the unit area, for which the recording has been performed by the previous scanning, on the upstream side in the Y direction in a similar manner to that in the previous scanning.

The scanning of the joint head 7 and the conveyance of the recording medium 3 are alternately repeated, to record an image on the entire area of the recording medium 3.

Figure 5:
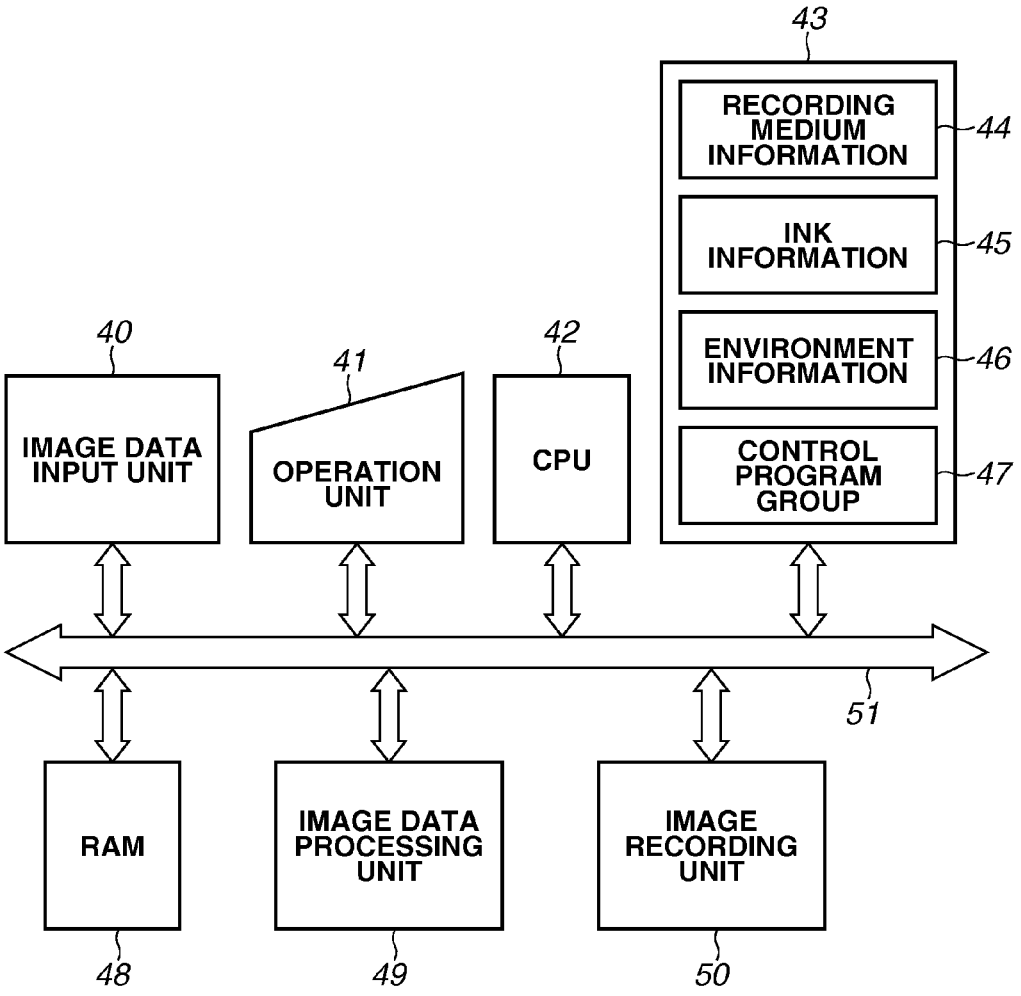
FIG. 5 is a block diagram illustrating a configuration of a recording control system in the exemplary embodiment.

FIG. 5 is a block diagram illustrating a schematic configuration of a recording control system in the present exemplary embodiment.

An image data input unit 40 is used to input image data from the outside. The image data input from the outside includes image data from an image input device such as a scanner or a digital camera and image data stored in a hard disk of a personal computer (PC). An operation unit 41 includes various types of keys. By operating the keys, various types of parameters can be set and an instruction to start recording can be issued.

A central processing unit (CPU) 42 controls processing such as calculation, selection, and determination with respect to the entire recording apparatus according to various types of programs in a storage medium 43. The storage medium 43 stores recording medium information 44 relating to the type of recording medium to be used, ink information 45 relating to the type of ink to be used, and environment information 46 relating to temperature and humidity when recording is performed. Further, the storage medium 43 also stores various types of control program groups 47 relating to recording. Conveyance control of the recording medium 3 and the joint head 7 and discharge control of the ink in the present exemplary embodiment are all functions corresponding to the control program groups 47. The storage medium 43 storing the various types of programs includes a read-only memory (ROM), a floppy disk (FD), a compact disk (CD)-ROM, a hard disk (HD), a memory card, and a magneto-optical disk.

A random access memory (RAM) 48 is used as a work area for the various types of programs in the storage medium 43, a temporary retreating area during error processing, and a work area during image processing. The RAM 48 can copy the various types of tables in the storage medium 43, and then perform image processing while changing contents of the tables and referring to the tables having the changed contents.

An image data processing unit 49 quantizes data representing an input multivalued image taking three or more values to data representing a binary image for each pixel, to generate an ink discharge pattern according to an image data processing procedure described below.

The CPU 42 distributes recording data to record the discharge pattern generated in the image data processing unit 49 in an image recording unit 50.

The image recording unit 50 discharges, based on the discharge pattern generated in the image data processing unit 49, the ink from the corresponding discharge port 30, to form a dot image on the recording medium 3. A bus line 51 transmits an address signal, data, and a control signal within the recording apparatus.

Figure 6:
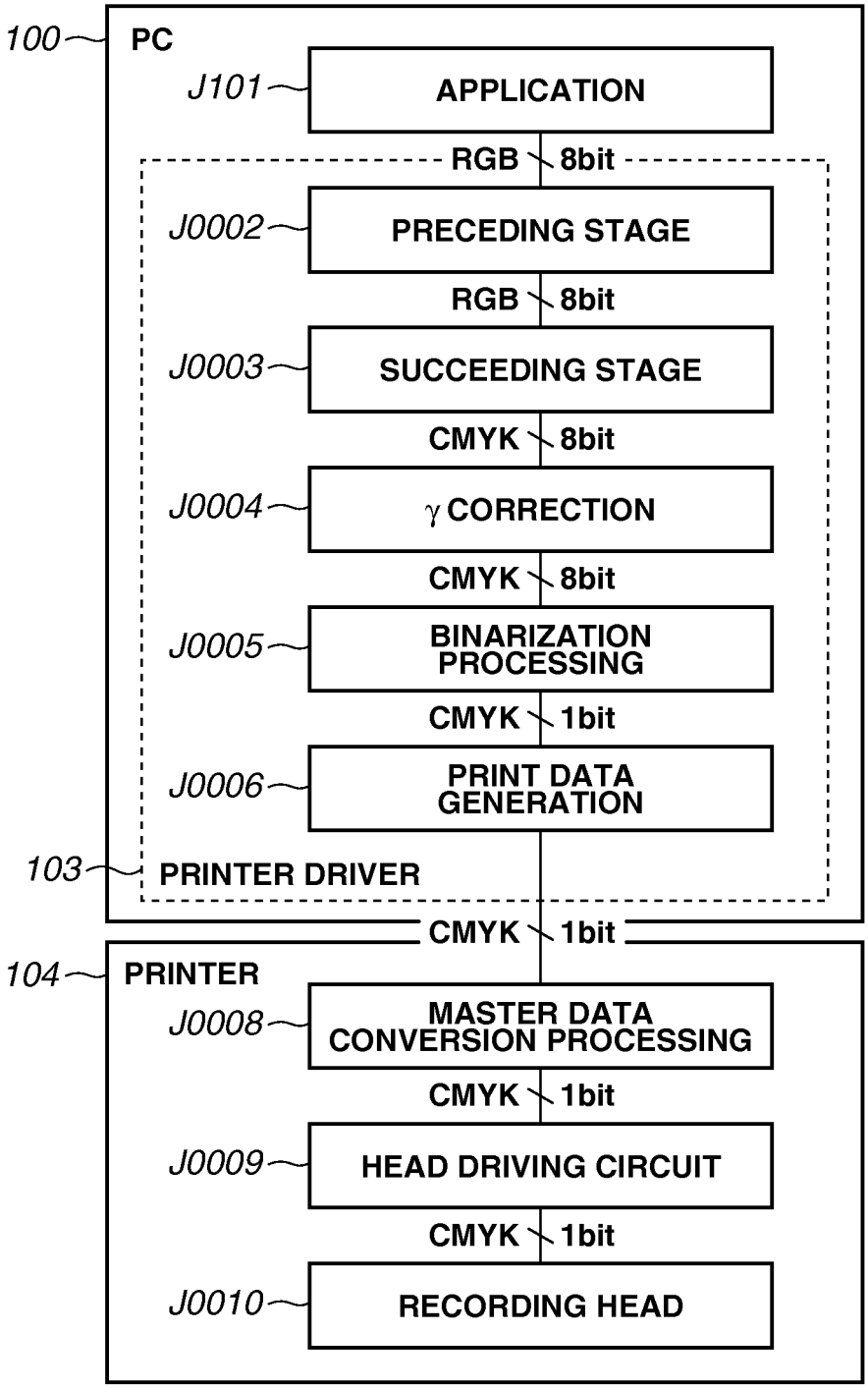
FIG. 6 is a flowchart for illustrating image data processing procedures in the exemplary embodiment.

FIG. 6 is a block diagram illustrating the data processing in the image data processing unit 49.

An application J101 in a PC 100 is used to generate image data to be recorded by a printer 104. The image data generated using the application J101 is transmitted to a printer driver 103 when recording is performed.

The printer driver 103 performs previous stage processing J0002, subsequent stage processing J0003, γ correction J0004, binarization processing J0005, and print data generation J0006 for the generated image data.

In the previous stage processing J0002, color gamut conversion for converting a color gamut of a display unit in the PC 100 into a color gamut of the printer 104 is performed. A three-dimensional look-up table is used to convert data R, G, and B representing images each expressed by eight bits into 8-bit data R, G, and B within the color gamut of the printer 104.

In the succeeding stage processing J0003, a color for reproducing the converted color gamut is separated into a color gamut of inks. Processing is carried out to find 8-bit data C, M, Y, and K corresponding to a combination of inks for reproducing colors represented by the 8-bit data R, G, and B within the color gamut of the printer 104 obtained in the previous stage processing J0002.

In the γ correction J0004, γ correction is performed for each of the 8-bit data C, M, Y, and K obtained in color separation. A conversion is performed such that each of the 8-bit data C, M, Y, and K obtained in the succeeding stage processing J0003 is linearly associated with a gradation characteristic of the printer 104 is performed.

In the binarization processing J0005, quantization processing for converting the 8-bit data C, M, Y, and K obtained in the γ correction J0004 into 1-bit data C, M, Y, and K is performed. A density pattern method, a dither method, and an error diffusion method are appropriately used as the quantization processing.

In the print data generation processing J0006, print control data is added to the data representing the image having the 1-bit data C, M, K, and Y obtained in the binarization processing J0005 as its contents, to generate 1-bit print data. The print control data includes recording medium information and recording quality information.

The print data generated in the above-mentioned manner is supplied to the printer 104.

In master data conversion processing J0008, the print data, which has been generated in the print data generation processing J0006 and input to the printer 104, is converted into recording data indicating whether dots are formed using data representing a mask pattern, as described below, i.e., the data is converted into recording data indicating ink recording or non-recording in the joint head 7.

This mask pattern has record permitted pixels and record non-permitted pixels arranged therein in a specific pattern. If the input print data is print data representing ink discharge, the print data is converted into recording data representing ink discharge in the record permitted pixels. If the input print data is print data representing ink non-discharge, the print data is converted into recording data representing ink non-discharge in the record non-permitted pixels. Among data representing the mask pattern, the data representing the record permitted pixels and the data representing the record non-permitted pixels are respectively represented by "1" and "0". Recording data is acquired by AND (logical product) processing of the data.

The mask pattern used in the mask data conversion processing J0008 is previously stored in a predetermined memory of the printer 104.

The recording data obtained in the mask data conversion processing J0008 is supplied to a head driving circuit J0009 and a recording head J0010. The ink is discharged to the recording medium 3 from each of the discharge ports 30 arranged in the joint head 7 based on the recording data.

A mask pattern to be applied in the present exemplary embodiment will be described in detail below.

Figure 7A:
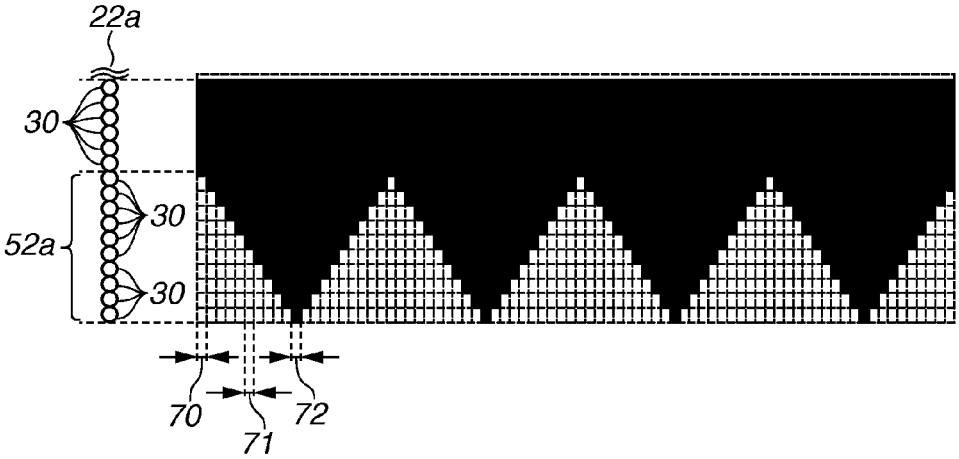
FIGS. 7A and 7B respectively illustrate mask patterns applied in the exemplary embodiment.
Figure 7B:
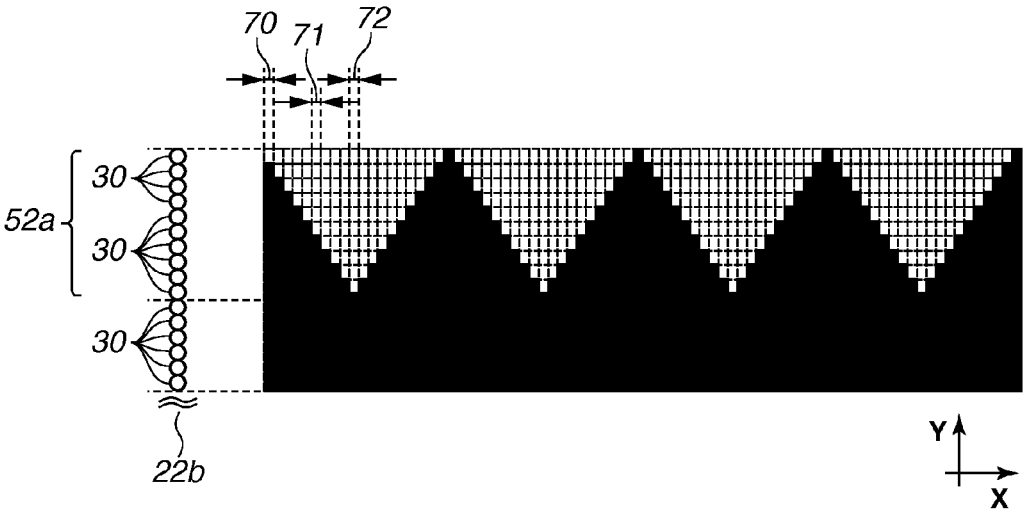
Figure 8A:
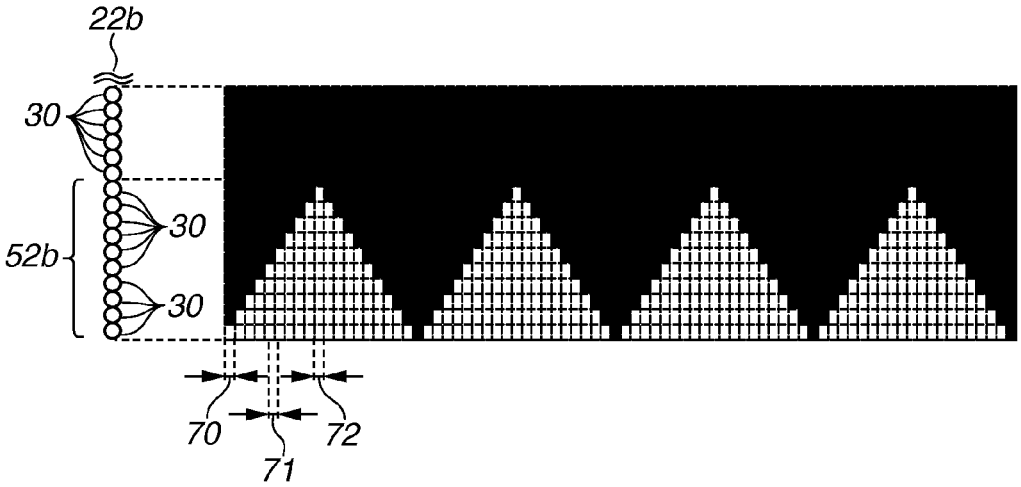
FIGS. 8A and 8B respectively illustrate mask patterns applied in the exemplary embodiment.
Figure 8B:
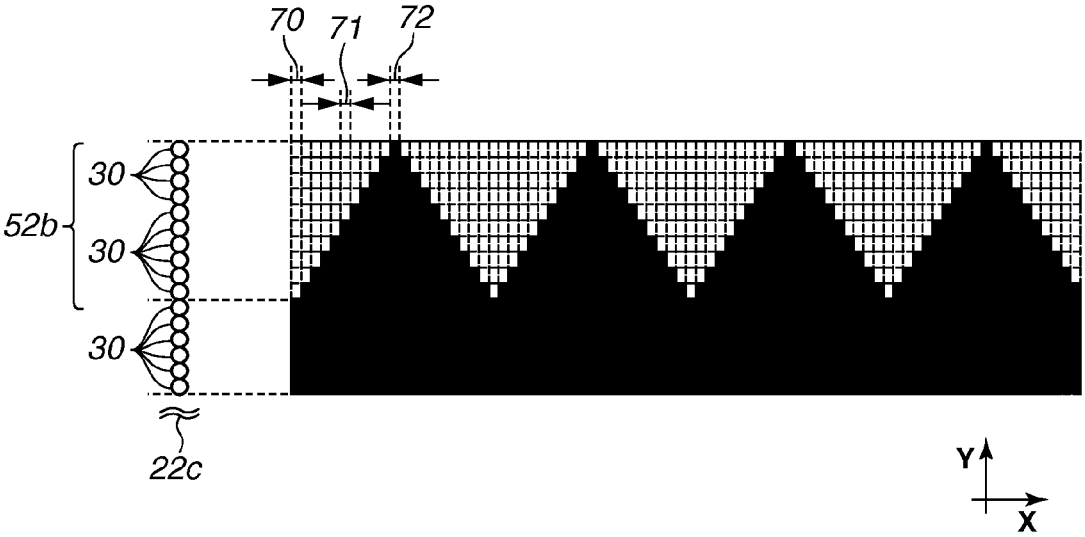

FIGS. 7A and 7B respectively illustrate mask patterns applied to discharge ports 30 arranged in the vicinity of an overlap portion 52*a* of discharge port arrays 22*a* and 22*b* in the joint head 7 in the present exemplary embodiment. FIGS. 8A and 8B respectively illustrate mask patterns applied to discharge ports 30 arranged in the vicinity of an overlap portion 52*b* of discharge port arrays 22*b* and 22*c* in the joint head 7 in the present exemplary embodiment.

In FIGS. 7 and 8, a blacked-out portion and a white-void portion respectively represent record permitted pixels and record non-permitted pixels. According to an arrangement of the record permitted pixels and the record non-permitted pixels, a recording ratio in each of the discharge ports 30 for recording the pixels is determined.

As illustrated in FIG. 7A, the mask pattern applied to the discharge ports 30 in the vicinity of the overlap portion 52*a* of the discharge port array 22*a* is divided into an area where the recording ratio is set to 100% so that inks are discharged for each pixel column from all the discharge ports 30 arranged therein and an area where the recording ratio is set to 0% so that no inks are discharged from the discharge ports arranged therein.

More specifically, the pixel column 70 to be recorded immediately after scanning of the joint head 7 is started is not first recorded by any of the discharge ports 30 arranged in the overlap portion 52*a* of the discharge port array 22*a*. More specifically, in the pixel column 70, the recording ratio in the 10 discharge ports 30 in the overlap portion 52*a* of the discharge port array 22*a* is set to 0%.

After that, every time a position of the pixel column changes in the X direction, the area where the recording ratio in the discharge ports 30 in the overlap portion 52*a* of the discharge port array 22*a* is 100%, increases by one pixel from the downstream side in the Y direction, and the area where the recording ratio in the discharge ports 30 is 0%, accordingly decreases by one pixel. In the pixel column 71, for example, among the 10 discharge ports 30 arranged in the overlap portion 52*a* of the discharge port array 22*a*, the recording ratio in the five discharge ports 30 on the upstream side in the Y direction is set to 0% and the recording ratio in the five discharge ports 30 on the downstream side in the Y direction is set to 100%.

In the pixel column 72, the recording ratio in all the 10 discharge ports 30 in the overlap portion 52*a* is set to 100%.

In the pixel column on the side away from the pixel column 72 in the X direction, every time a position of the pixel column changes in the X direction, the discharge ports 30 in which the recording ratio is set to 0%, continuously increase by one from the upstream side in the Y direction, and the discharge ports 30 in which the recording ratio is set to 100%, continuously decrease accordingly by one from the downstream side in the Y direction in response thereto.

Thus, in the mask pattern applied to the 10 discharge ports 30 in the overlap portion 52*a* of the discharge port array 22*a*, the recording ratios in each of the pixel columns are determined in such a manner that inks are not discharged from the M discharge ports 30 on the upstream side in the Y direction and, are discharged at the recording ratio of 100% from the 10−M discharge ports 30 on the downstream side in the Y direction. Further, as the position of the pixel column changes by one pixel in the X direction, the recording ratios in each of the pixel columns are determined in such a manner that the value of M continuously increases or decreases by one.

As illustrated in FIG. 7B, the mask pattern applied to the overlap portion 52*a* of the discharge port array 22*b* is obtained by exchanging areas between where the recording ratio is 0% and where the recording ratio is 100% in the mask pattern applied to the overlap portion 52*a* of the discharge port array 22*a* illustrated in FIG. 7A.

More specifically, in the mask pattern applied to the 10 discharge ports 30 in the overlap portion 52*a* of the discharge port array 22*b*, for each of the pixel columns, inks are not discharged from the 10−M discharge ports 30 on the downstream side in the Y direction and inks are discharged at the recording ratio of 100% from the M discharge ports on the upstream side in the Y direction. The recording ratios in the pixel column are determined such that as a position of the pixel column changes by one pixel in the X direction, the value of M continuously increases or decreases by one.

On the other hand, as illustrated in FIG. 8A, the mask pattern applied to the discharge ports 30 in the overlap portion 52*b* of the discharge port array 22*b* includes, for each pixel column, an area where the recording ratio is set to 100% so that inks are discharged from all the discharge ports 30 arranged therein and an area where the recording ratio is set to 0% so that no inks are discharged from the discharge ports 30 arranged therein. Further, a setting is made such that a variation tendency of a boundary between the area where the recording radio is 100% and the area where the recording ratio is 0% in the pixel column, differs from a variation tendency of the boundary in the mask pattern applied to the discharge ports 30 in the overlap portion 52*a* of the discharge port array 22*a*.

In the pixel column 70, the recording ratio in all the 10 discharge ports 30 arranged in the overlap portion 52*b* of the discharge port array 22*b* is set to 100% so that inks are discharged from all of the 10 discharge ports 30. As described above, in the pixel column 70, the recording ratio in all of the 10 discharge ports 30 in the overlap portion 52*a* of the discharge port array 22*a* is set to 0%.

After that, every time a position of the pixel column changes in the X direction, in the 10 discharge ports 30 in the overlap portion 52*b* of the discharge port array 22*b*, the area where the recording ratio is 0%, continuously increases by one pixel from the downstream side in the Y direction. Correspondingly, the area where the recording ratio is 100%, continuously decreases by one pixel. In the pixel column 71, for example, among the 10 discharge ports 30 arranged in the overlap portion 52*b* of the discharge port array 22*b*, the recording ratio in the five discharge ports 30 on the upstream side in the Y direction is set to 0%, and the recording ratio in the five discharge ports 30 on the downstream side in the Y direction is set to 100%.

In the pixel column 72, the recording ratio in all of the 10 discharge ports 30 in the overlap portion 52*a* is set to 0%.

Further, in the pixel column on the side away from the pixel column 72 in the X direction, every time a position of the pixel column changes by one pixel in the X direction, the discharge ports 30 in which the recording ratio is set to 100%, continuously increases by one from the upstream side in the Y direction, and the discharge ports 30 in which the recording ratio is set to 0%, continuously decreases by one accordingly from the downstream side in the Y direction.

Thus, in the mask pattern applied to the 10 discharge ports 30 in the overlap portion 52*b* of the discharge port array 22*b*, the recording ratios in each of the pixel columns are determined such that inks are not discharged from the K discharge ports on the upstream side in the Y direction and are discharged at the recording ratio of 100% from the 10−K discharge ports on the downstream side in the Y direction, similar to the mask pattern applied to the 10 discharge ports 30 in the overlap portion 52*a* of the discharge port array 22*a*. Further, as the position of the pixel column changes by one pixel in the X direction, the recording ratios in each of the pixel columns are determined such that the value of K continuously increases or decreases by one with a tendency different from the tendency of the increase or decrease of the value of M in the mask pattern applied to the 10 discharge ports in the overlap portion 52*a* of the discharge port array 22*a* illustrated in FIG. 7A.

Thus, the value of K in the mask pattern illustrated in FIG. 8A and the value of M in the mask pattern illustrated in FIG. 7A are set to differ from each other. For example, M=10 and K=0 in the pixel column 70, and M=0 and K=10 in the pixel column 72.

As illustrated in FIG. 8B, the mask pattern applied to the overlap portion 52*b* of the discharge port array 22*c* is obtained by exchanging areas between where the recording ratio is 0% and where the recording ratio is 100% in the mask pattern applied to the overlap portion 52*b* of the discharge port array 22*b* illustrated in FIG. 8A.

More specifically, in the mask pattern applied to the 10 discharge ports 30 in the overlap portion 52*b* of the discharge port array 22*c*, for each of the pixel columns, inks are not discharged from the 10−K discharge ports on the downstream side in the Y direction and are discharged at the recording ratio of 100% from the K discharge ports 30 on the upstream side in the Y direction. The recording ratios in each of the pixel columns are determined such that the value of K continuously increases or decreases by one as a position of the pixel column changes in the X direction.

Figure 9:
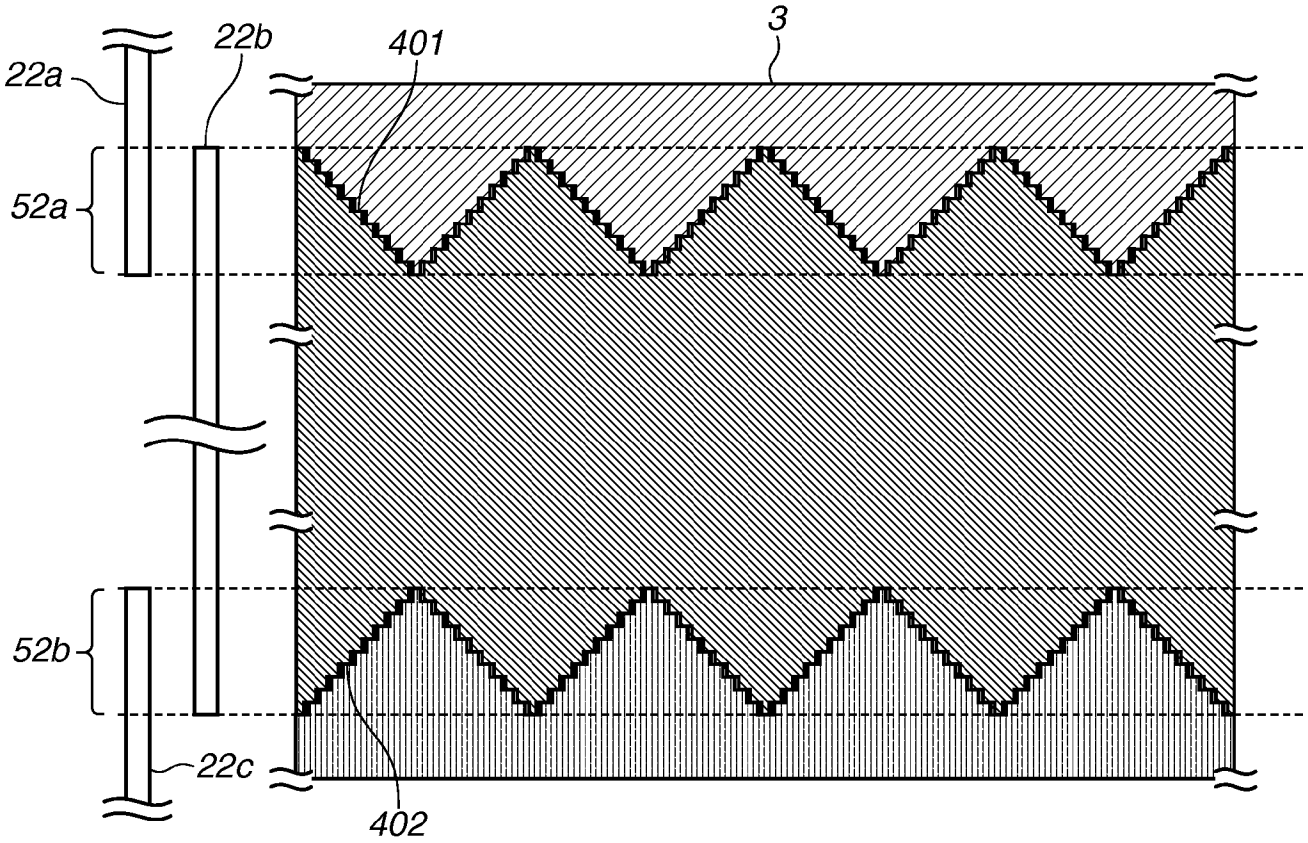
FIG. 9 illustrates an image recorded according to the mask pattern applied in the exemplary embodiment.

FIG. 9 illustrates an image formed on the recording medium 3 when recording is performed using the mask pattern in the present exemplary embodiment.

For simplicity, image data is illustrated in which inks have been discharged onto all pixels on the recording medium 3 (hereinafter referred to as a solid image).

According to the mask patterns described in the present exemplary embodiment, a boundary 401 between dots formed by discharge from the discharge port array 22*a* and dots formed by discharge from the discharge port array 22*b* in an area corresponding to the overlap portion 52*a* on the recording medium 3, and a boundary 402 between dots formed by discharge from the discharge port array 22*b* and dots formed by discharge from the discharge port array 22*c* in an area corresponding to the overlap portion 52*b* on the recording medium 3, are formed such that they continuously vary as their respective positions in the X direction change, as illustrated in FIG. 9. Further, a variation pattern (shape) of the boundary 401 and a variation pattern (shape) of the boundary 402 can be made to differ from each other. More specifically, phases of periodical triangular wave patterns of the boundary 401 and the boundary 402 can be made different from each other. Thus, the variation patterns of the boundaries in the entire recorded image can be inhibited from mutually emphasizing themselves in the two overlap portions 52*a* and 52*b* that goes close in the Y direction, and unevenness of the image can be made inconspicuous.

In the first exemplary embodiment, the discharge ports in the overlap portion of the discharge port array are divided into the area where the recording ratio is set to 0% and the area where the recording ratio is set to 100% in each of the pixel columns.

On the other hand, in a second exemplary embodiment, discharge ports in an overlap portion of a discharge port array are divided into three areas, i.e., an area where the recording ratio is set to 0%, an area where the recording ratio is set to 50%, and an area where the recording ratio is set to 100% in each pixel column.

Description of a similar part to that in the first exemplary embodiment is not repeated.

Figure 10A:
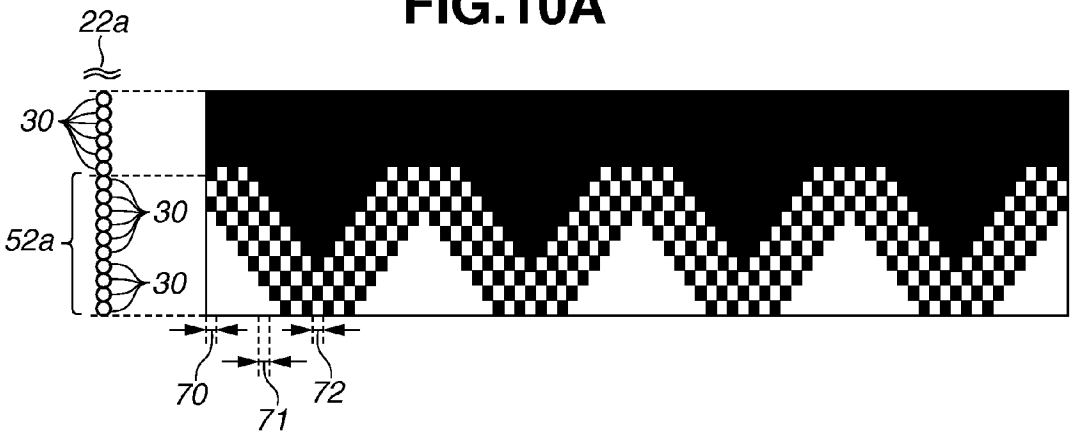
FIGS. 10A and 10B respectively illustrate mask patterns applied in an exemplary embodiment.
Figure 10B:
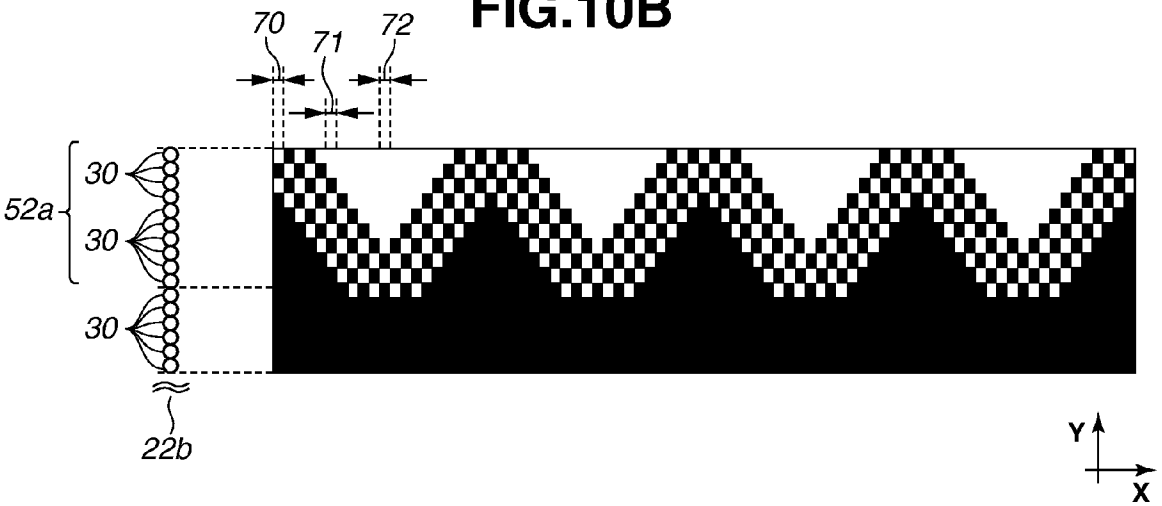
Figure 11A:
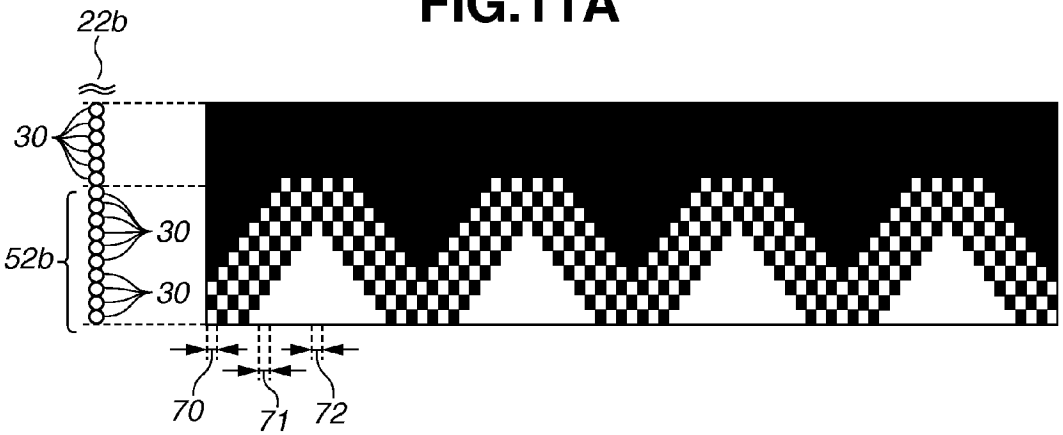
FIGS. 11A and 11B respectively illustrate mask patterns applied in the exemplary embodiment.
Figure 11B:
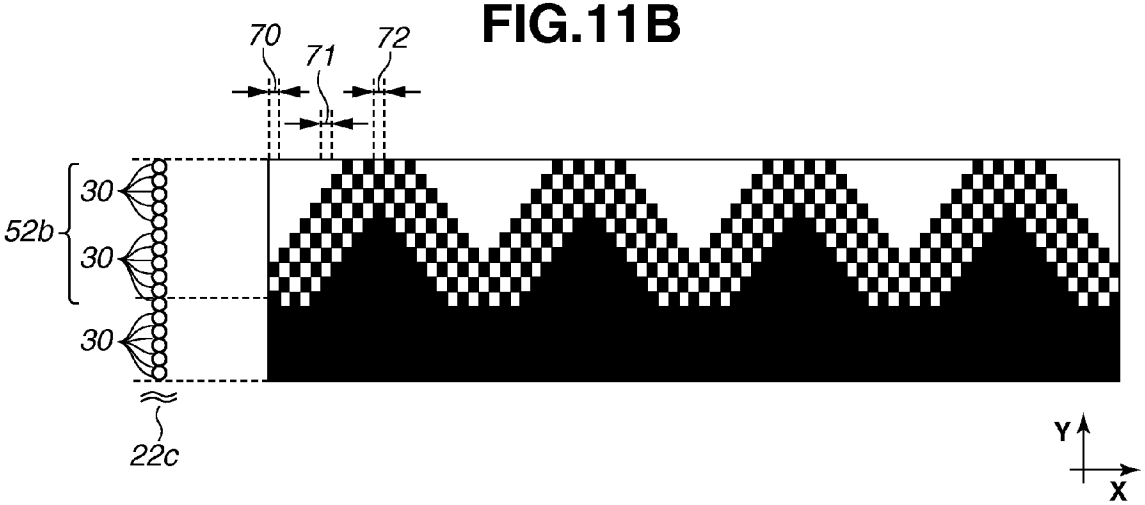

FIGS. 10A and 10B respectively illustrate mask patterns applied to discharge ports 30 arranged in the vicinity of an overlap portion 52*a* of discharge port arrays 22*a* and 22*b* in a joint head 7 in the present exemplary embodiment. FIGS. 11A and 11B respectively illustrate mask patterns applied to discharge ports 30 arranged in the vicinity of an overlap portion 52*b* of discharge port arrays 22*b* and 22*c* in the joint head 7 in the present exemplary embodiment.

A mask pattern applied to the 10 discharge ports 30 in the overlap portion 52*a* of the discharge port array 22*a* includes for each of the pixel columns three areas, i.e., an area where the recording ratio is set to 100%, an area where the recording ratio is set to 50%, and an area where the recording ratio is set to 0%.

In each of the pixel columns, among the 10 discharge ports 30 in the overlap portion 52*a* of the discharge port array 22*a*, the recording ratio in the M ($0 \leq M \leq 7$) discharge ports 30 on the upstream side in a Y direction is set to 0%, and the recording ratio in the L ($0 \leq L \leq 7-M$) discharge ports 30 on the downstream side in the Y direction is set to 100%. The recording ratio in the remaining 10−(M+L) discharge ports 30 is set to 50%. Further, as a position of the pixel column changes in an X direction, values of M and L are set to continuously increase or decrease by one.

More specifically, in the pixel column 70, for example, the values of M and L are respectively set to 7 and 0. Therefore, inks are not discharged from the seven discharge ports 30 on the upstream side in the Y direction and inks are discharged according to the recording ratio of 50% from the three discharge ports 30 on the downstream side in the Y direction.

In the pixel column 71, the values of M and L are respectively set to 2 and 2. Therefore, inks are not discharged from the two discharge ports 30 on the upstream side in the Y direction, are discharged according to the recording ratio of 100% from the two discharge ports 30 on the downstream side in the Y direction, and are discharged according to the recording ratio of 50% from the six discharge ports 30 therebetween.

Further, in the pixel column 72, the values of M and L are respectively set to 0 and 7. Therefore, inks are discharged according to the recording ratio of 50% from the three discharge ports 30 on the upstream side in the Y direction, and are discharged according to the recording ratio of 100% from the seven discharge ports 30 on the downstream side in the Y direction.

Thus, in the mask pattern applied to the overlap portion 52*a* of the discharge port array 22*a* in the present exemplary embodiment, every time a position of the pixel column moves by one pixel in the X direction, the value of M continuously decreases by one from seven to zero, and then continuously increases by one from zero to seven. On the other hand, the value of K continuously increases by one from zero to seven, and then continuously decreases by one from seven to zero corresponding to the increase or decrease of the value of M.

As illustrated in FIG. 10B, the mask pattern applied to the overlap portion 52*a* of the discharge port array 22*b* is obtained by exchanging the areas between where the recording ratio is 0% and where the recording ratio is 100% in the mask pattern applied to the overlap portion 52*a* of the discharge port array 22*a* illustrated in FIG. 10A. Each of the mask pattern applied to the overlap portion 52*a* of the discharge port array 22*a* and the mask pattern applied to the overlap portion 52*a* of the discharge port array 22*b* is set such that in an area where the recording ratio is set to 50%, record permitted pixels are mutually complimentary and exclusive.

On the other hand, as illustrated in FIG. 11A, the mask pattern applied to discharge ports 30 in the overlap portion 52*b* of the discharge port array 22*b* includes, for each of the pixel columns, an area where the recording ratio is set to 100%, an area where the recording ratio is set to 50%, and an area where the recording ratio is set to 0%. Further, the mask pattern is set such that a continuous variation tendency of a boundary between the area where the recording ratio is 100% and the area where the recording ratio is 50% and a boundary between the area where the recording ratio is 50% and the area where the recording ratio is 0% differs from a continuous variation tendency of a boundary in the mask pattern applied to the discharge ports 30 in the overlap portion 52*a* of the discharge port array 22*a*.

More specifically, in each of the pixel columns, with respect to the 10 discharge ports 30 in the overlap portion 52*b* of the discharge port array 22*b*, among the 10 discharge ports 30 in the overlap portion 52*a* of the discharge port array 22*a*, the recording ratio in the K ($0 \leq K \leq 7$) discharge ports 30 on the upstream side in the Y direction is set to 0%, and the recording ratio in the J ($0 \leq J \leq 7-K$) discharge ports 30 on the downstream side in the Y direction is set to 100%. The recording ratio in the remaining 10−(K+J) discharge ports 30 is set to 50%. Further, as a position of the pixel column changes in the X direction, values of K and J are set such that they continuously increase or decrease by one in a tendency differently from a tendency of the continuous increase or decrease of the values of M and L in the 10 discharge ports 30 in the overlap portion 52*a* of the discharge port array 22*a* illustrated in FIG. 10A.

More specifically, the values of K and J are respectively set to 0 and 7 in the pixel column 70. In the 10 discharge ports 30 in the overlap portion 52*a* of the discharge port array 22*a*, the values of M and L are respectively set to 7 and 0 in the pixel column 70.

The values of K and J are respectively set to 2 and 2 in the pixel column 71, and 7 and 0 in the pixel column 72.

Thus, in the mask pattern applied to the overlap portion 52*b* of the discharge port array 22*b* in the present exemplary embodiment, every time the position of the pixel column moves by one pixel in the X direction, the value of K continuously increases by one from zero to seven, and then continuously decreases by one from seven to zero. On the other hand, the value of J continuously decreases by one from seven to zero, and then continuously increases by one from zero to seven corresponding to the increase or decrease of the value of K. When the values increase or decrease, the value of K increases or decreases in a tendency different from the increase or decrease of the value of M, and the value of J increases or decreases in a tendency different from the increase or decrease of the value of L.

As illustrated in FIG. 11B, the mask pattern applied to the overlap portion 52*b* of the discharge port array 22*c* is obtained by exchanging the areas between where the recording ratio is 0% and where the recording ratio is 100% in the mask pattern applied to the overlap portion 52*b* of the discharge port array 22*c* illustrated in FIG. 11A. Each of the mask pattern applied to the overlap portion 52*b* of the discharge port array 22*b* and the mask pattern applied to the overlap portion 52*b* of the discharge port array 22*c* is set such that in an area where the recording ratio is set to 50%, record permitted pixels are mutually complementary and exclusive.

According to the mask patterns described in the present exemplary embodiment, two boundaries, i.e., a first boundary between a dot group formed by discharge from the discharge port array 22*a* and a dot group formed by discharge from both the discharge port array 22*a* and the discharge port array 22*b*, and a second boundary between a dot group formed by discharge from the discharge port array 22*b* and a dot group formed by discharge from both the discharge port array 22*a* and the discharge port array 22*b* in an area corresponding to the overlap portion 52*a* on the recording medium 3 are formed such that they continuously vary as their respective positions in the X direction change, to form a triangular wave shape. Simultaneously, two boundaries, i.e., a third boundary between a dot group formed by discharge from the discharge port array 22*b* and a dot group formed by discharge from both the discharge port array 22*b* and the discharge port array 22*c*, and a fourth boundary between a dot group formed by discharge from the discharge port array 22*c* and a dot group formed by discharge from both the discharge port array 22*b* and the discharge port array 22*c* in an area corresponding to the overlap portion 52*b* on the recording medium 3 are also formed such that they continuously vary as their respective positions in the X direction change, to form a triangular wave shape. Further, the first boundary and the third boundary, and the second boundary and the fourth boundary can respectively be formed in different variation patterns (shapes). Thus, the variation patterns forming the boundaries in the entire recorded image can be inhibited from overlapping each other in the two overlap portions 52*a* and 52*b* which come close to each other in the Y direction.

Further, according to the mask pattern described in the present exemplary embodiment, the recording ratio in the discharge ports 30 at an end of each discharge port array in the Y direction in the joint head 7 can be gradually decreased. Thus, an end twist caused by a self air current associated with ink discharge can be prevented.

In the present exemplary embodiment, an arrangement of the record permitted pixels and the record non-permitted pixels in an area corresponding to 10−(M+L) discharge ports 30 other than the M discharge ports 30 on the upstream side and the L discharge ports 30 on the downstream side in the mask pattern applied to the 10 discharge ports 30 in the overlap portion 52*a* can be determined, as needed. While the record permitted pixels and the record non-permitted pixels form a checkerboard pattern in the present exemplary embodiment, the present exemplary embodiment is not limited to such a form. In the area corresponding to the 10−(M+

L) discharge ports 30 within the mask pattern, the record permitted pixels corresponding to the discharge port array 22*a* and the record permitted pixels corresponding to the discharge port array 22*b* are preferably arranged to be the same as much as possible to prevent displacement of the discharge ports 30 to be used. However, even if the discharge ports 30 are displaced toward one side, an effect of inhibiting unevenness in the overlap portion 52*a* is not undermined. The shape is not limited to the checkerboard pattern, and is sufficient if the record permitted pixels corresponding to the discharge port array 22*a* and the record permitted pixels corresponding to the discharge port array 22*b* are arranged in a somewhat dispersed manner.

While the continuous increase or decrease tendencies of the values of K and M are configured to differ from each other, and the continuous increase or decrease tendencies of the values of L and J are configured to differ from each other, in the present exemplary embodiment, the effect of the present exemplary embodiment can also be obtained if the continuous increase or decrease tendencies of the values in either one of a combination of the values of K and M and a combination of the values of L and J may be configured to differ from each other.

While the value of M in the overlap portion 52*a* of the discharge port array 22*a* continuously increases or decreases by one in the above-mentioned exemplary embodiments, another form of embodiment is possible. If a shape of a continuous variation of a boundary does not steeply change in a Y direction in two adjacent pixel columns in an X direction, the effect of the disclosure can be achieved. More specifically, if a discharge port array having a plurality of discharge ports arranged at a density of 600 dpi is used, for example, a maximum value of a difference between values of M in two adjacent pixel columns on a recording medium just has to be three or less (corresponding to approximately 120 μm or less in distance). If a discharge port array having a plurality of discharge ports arranged at a density of 1200 dpi is used, a maximum value of a difference between values of M in two adjacent pixel columns just has to be six or less (corresponding to approximately 120 μm or less in distance). The same is true for values of K, L, and J.

While the mask pattern in which the shapes of the boundaries are the triangular wave shape in the above-mentioned exemplary embodiments, the positions in the Y direction of the boundaries just have to continuously vary with a certain width in the Y direction as the positions of the boundaries in the X direction change, and the shape of the boundary is not limited to the triangular wave shape. For example, the shape of the boundary may be a sine wave or a saw-tooth. The shape of the boundary need not necessarily be a periodical pattern shape.

While the wave patterns in the boundaries are described as opposite in phase to each other as a particularly effective configuration in the above-mentioned exemplary embodiments, the disclosure can be implemented using another form. For example, even if the wave patterns differ in period and amplitude or even if the wave patterns differ in phase to some extent, the effect of the disclosure can be obtained.

While the shapes of the boundaries in the two adjacent overlap portions in the Y direction are different from each other in the above-mentioned exemplary embodiments, shapes of boundaries in all of the overlap portions within the joint head need not be made different from each other in the present exemplary embodiment. Unevenness caused by an overlap of the shapes of the boundaries in the two overlap portions more conspicuously appears when the two overlap portions are positioned adjacent to each other in the Y direction. Thus, if the shapes of the boundaries in the two adjacent overlap portions in the Y direction are respectively continuously changed, and the shapes of the boundaries are made different from each other, the effect of the disclosure can be obtained. For example, the mask patterns illustrated in FIGS. 7A and 7B and the mask patterns illustrated in FIGS. 8A and 8B may be alternately applied to the 17 overlap portions arranged in the Y direction in the joint head including the 18 discharge port arrays illustrated in FIG. 4A. Even if all the shapes of the boundaries in the 17 overlap portions are different from one another, the effect of the disclosure can also be achieved.

While the number of the discharge ports 30 arranged in each of the overlap portions 52 of the first and second discharge port arrays is 10 in the above-mentioned exemplary embodiments, an embodiment achieves a sufficient effect if N discharge ports arranged at one end of a first discharge port array and N discharge ports arranged at the other end of a second discharge port array are arranged to form the same N pixel rows on a recording medium. However, as a result of an examination by the inventors, am embodiment achieves a more significant effect because the amplitude of the shape of a boundary between the discharge port arrays on the recording medium can be increased to some extent if the number of discharge ports arranged in the overlap portion of the discharge port arrays is 10 or more.

While according to each of the above-mentioned exemplary embodiments, the recording apparatus performs recording on the recording medium by scanning a plurality of times, the disclosure can be implemented in another form.

Figure 12:
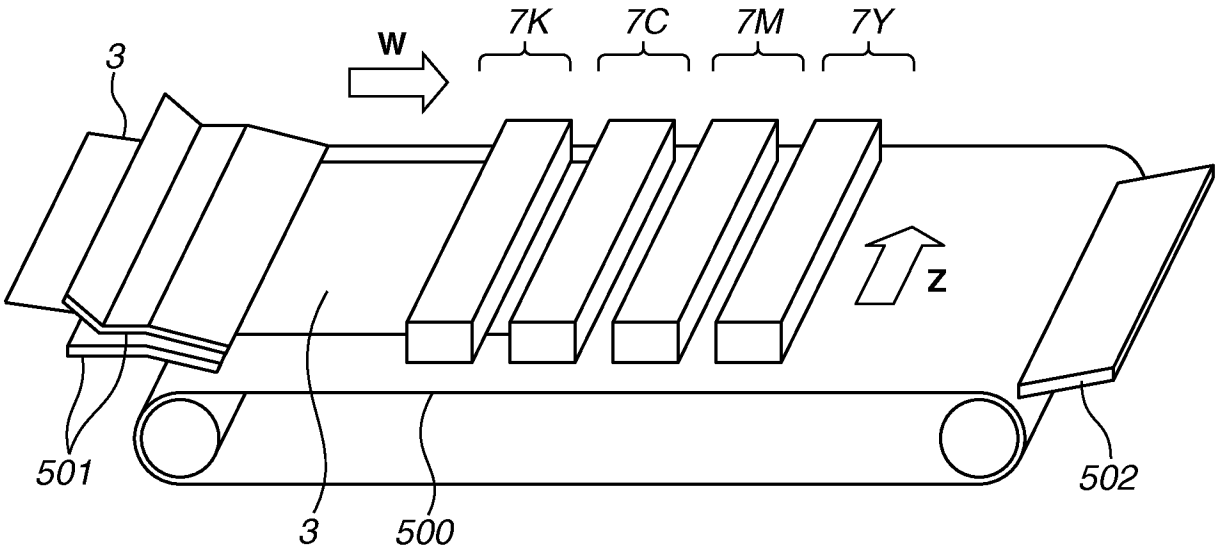
FIG. 12 is a perspective view of another recording apparatus to which an embodiment is applied.

FIG. 12 illustrates another recording apparatus to which an embodiment is applicable.

In the recording apparatus illustrated in FIG. 12, a W direction corresponds to a conveyance direction in the recording apparatus described in each of the exemplary embodiments, and a Z direction corresponds to an arrangement direction and a scanning direction in the recording apparatus described in each of the exemplary embodiments.

Joint heads 7C, 7M, 7Y, and 7K, each including a plurality of discharge port arrays arranged in a Z direction and respectively corresponding to cyan inks, magenta inks, yellow inks, and black inks, are arranged in a W direction intersecting the Z direction. The length in the Z direction of each of the joint heads 7C, 7M, 7Y, and 7K is equal to or more than the length in the Z direction of the recording medium 3 so that recording can be performed at one time on the entire area in the Z direction on the recording medium 3.

A conveyance belt 500 is a belt for conveying the recording medium 3, and is rotatably retained in the W direction by a sheet feeding unit 501 and a sheet discharge unit 502. The recording medium 3 is fed by the sheet feeding unit 501, and is conveyed in the W direction by the conveyance belt 500. The ink is discharged from each of the joint heads 7C, 7M, 7Y, and 7K to record an image while the recording medium 3 is conveyed in the W direction.

Even if the recording apparatus that performs recording on the recording medium 3 by performing scanning (conveyance) once, the shapes of boundaries in two adjacent overlap portions in the Z direction within the one joint head respectively continuously vary to be different from each other, the effect of the disclosure can be obtained.

OTHER EMBODIMENTS

Embodiments of the disclosure can also be realized by a computer of a system or apparatus that reads out and executes computer executable instructions recorded on a storage medium (e.g., non-transitory computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The recording apparatus and the recording method in an example of the disclosure can inhibit variation patterns of boundaries in the entire recorded image from mutually emphasizing themselves in a plurality of overlap portions and can make unevenness of the image inconspicuous.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2013-229750 filed Nov. 5, 2013, which is hereby incorporated by reference herein in its entirety.

What is claimed is:

1. A recording apparatus that records an image, comprising:

a recording head including at least first, second, and third discharge port arrays each having a plurality of discharge ports for discharging inks having the same color arranged in a predetermined direction, the first, second, and third discharge port arrays being displaced from one another in the predetermined direction so that N number of first discharge ports arranged at an end on the first side in the predetermined direction of the first discharge port array and N number of second discharge ports arranged at an end on the second side opposite to the first side in the predetermined direction of the second discharge port array are arranged in a direction intersecting the predetermined direction to form a first overlap portion for discharging the inks to the same area on a recording medium, and N number of third discharge ports arranged at an end on the first side in the predetermined direction of the second discharge port array and N number of fourth discharge ports arranged at an end on the second side in the predetermined direction of the third discharge port array are arranged in the intersecting direction to form a second overlap portion for discharging the inks to the same area on the recording medium; and a control unit configured to performs control to discharge the inks to the recording medium from the recording head according to recording ratios respectively determined for the N number of first discharge ports, the N number of second discharge ports, the N number of third discharge ports, and the N number of fourth discharge ports while relatively scanning in the intersecting direction of the recording head and the recording medium, wherein the control unit controls the discharge of the inks in each of pixel columns including a plurality of pixels arranged in the predetermined direction on the recording medium so that (i) the inks are not discharged, among the N number of first discharge ports, from M ($0 \le M \le N$) number of discharge ports on the first side in the predetermined direction and are discharged according to the first recording ratio from L ($0 \le L \le N-M$) number of discharge ports on the second side in the predetermined direction, (ii) the inks are not discharged, among the N number of second discharge ports, from the L number of discharge ports on the second side in the predetermined direction and are discharged according to the first recording ratio from the M number of discharge ports on the first side in the predetermined direction, (iii) the inks are not discharged, among the N number of third discharge ports, from K ($0 \le K \le N$) number of discharge ports on the first side in the predetermined direction and are discharged according to the second recording ratio from J ($0 \le J \le N-K$) number of discharge ports on the second side in the predetermined direction, and (iv) the inks are not discharged, among the N number of fourth discharge ports, from the J number of discharge ports on the second side in the predetermined direction and are discharged according to the second recording ratio from the K number of discharge ports on the first side in the predetermined direction, and wherein respective values in at least one of a first set of the M and the K and a second set of the L and the J continuously increase or decrease as a position of the pixel column in the intersecting direction on the recording medium changes, and the respective values differ from each other when the position of the pixel column in the intersecting direction on the recording medium is a predetermined position.

2. The recording apparatus according to 1, wherein each of the first, second, and third discharge port arrays has the plurality of discharge ports arranged therein in the arrangement direction at a density of 600 dpi, and a maximum value of a difference between values in at least one of the first set and the second set, between the adjacent two pixel columns in the intersecting direction on the recording medium is three or less.

3. The recording apparatus according to 2, wherein maximum values of differences between respective values in at least one of the first set and the second set, between the two adjacent pixel columns in the intersecting direction on the recording medium are respectively three or less.

4. The recording apparatus according to claim 1, wherein $$L=N-M.$$

5. The recording apparatus according to claim 4, wherein $$J=N-K.$$

6. The recording apparatus according to claim 1, wherein the second recording ratio is equal to the first recording ratio.

7. The recording apparatus according to claim 6, wherein the first recording ratio is 100%.

8. The recording apparatus according to claim 1, wherein respective values in at least one of the first set and the second set, periodically increase or decrease as the position of the pixel column in the intersecting direction on the recording medium changes.

9. The recording apparatus according to claim 1, wherein tendencies of continuous increase or decrease of respective values in at least one of the first set and the second set differ from each other.

10. The recording apparatus according to claim 1, wherein recording data used to record an image is generated based on image data and a mask pattern including record permitted pixels and record non-permitted pixels.

11. The recording apparatus according to claim 1, wherein a boundary of a first image recorded on the recording medium by the discharge of the inks from the L number of discharge ports among the N number of first discharge ports, at the respective positions of the pixel columns in the intersecting direction has a wave shape, and a boundary of a second image recorded on the recording medium by the discharge of the inks from the J number of discharge ports among the N number of third discharge ports, at the respective positions of the pixel columns in the intersecting direction has a wave shape.

12. The recording apparatus according to claim 11, wherein the wave shape in the boundary of the first image and the wave shape in the boundary of the second image are triangular wave shapes.

13. The recording apparatus according to 11, wherein a phase of the wave shape of the boundary of the second image differs from a phase of the wave shape in the boundary of the first image.

14. The recording apparatus according to claim 13, wherein the phase of the wave shape of the boundary of the second image is opposite to the phase of the wave shape of the boundary of the first image.

15. The recording apparatus according to claim 11, wherein the wave shape of the boundary of the second image differs from a period of the wave shape of the boundary of the first image.

16. The recording apparatus according to claim 11, wherein an amplitude of the wave shape of the boundary of the second image differs from an amplitude of the wave shape in the boundary of the first image.

17. The recording apparatus according to claim 1, wherein the recording head has a length corresponding to the width of the recording medium in the predetermined direction, and records an image on the recording medium by performing the scanning once.

18. A recording apparatus that records an image, comprising:

a recording head including at least first, second, and third discharge port arrays each having a plurality of discharge ports for discharging inks having the same color arranged in a predetermined direction, the first, second, and third discharge port arrays being displaced from one another in the predetermined direction so that N number of discharge ports arranged at one end in the predetermined direction of the first discharge port array and N number of discharge ports arranged at an end on the side of the first discharge port array in the predetermined direction of the second discharge port array are arranged in a direction intersecting the predetermined direction to form a first overlap portion for discharging the inks to the same area on a recording medium, and N number of discharge ports arranged at one end in the predetermined direction of the second discharge port array and N number of discharge ports arranged at an end on the side of the second discharge port array in the predetermined direction of the third discharge port array are arranged in the intersecting direction to form a second overlap portion for discharging the inks to the same area on the recording medium;

a scanning unit configured to perform relative scanning in the intersecting direction of the recording head and the recording medium; and a control unit configured to perform control to discharge the inks from the recording head to record a plurality of dots on the recording medium while scanning the recording head by the scanning unit, wherein the control unit controls the discharge of the inks to record dot columns each including a plurality of dots arranged in the predetermined direction on the recording medium so that (i) among the dots formed in an area on the recording medium corresponding to the first overlap portion, the dots closer to the side of the first discharge port array in the predetermined direction than a first boundary on the recording medium are formed by discharging the inks from the discharge ports in the first discharge port array, and the dots closer to the side of the second discharge port array in the predetermined direction than the first boundary on the recording medium are formed by discharging the inks from the discharge ports in the second discharge port array, and (ii) among the dots formed in an area on the recording medium corresponding to the second overlap portion, the dots closer to the side of the second discharge port array in the predetermined direction than a second boundary on the recording medium are formed by discharging the inks from the discharge ports in the second discharge port array, and the dots closer to the side of the third discharge port array in the predetermined direction than the second boundary on the recording medium are formed by discharging the inks from the discharge ports in the third discharge port array, and the shape of the second boundary differs from the shape of the first boundary.

19. A recording apparatus that records an image, comprising:

a recording head including at least first, second, and third discharge port arrays each having a plurality of discharge ports for discharging inks having the same color arranged in a predetermined direction, the first, second, and third discharge port arrays being displaced from one another in the predetermined direction so that N number of discharge ports arranged at one end in the predetermined direction of the first discharge port array and N number of discharge ports arranged at an end on the side of the first discharge port array in the predetermined direction of the second discharge port array are arranged in a direction intersecting the predetermined direction to form a first overlap portion for discharging the inks to the same area on a recording medium, and N number of discharge ports arranged at one end in the predetermined direction of the second discharge port array and N number of discharge ports arranged at an end on the side of the second discharge port array in the predetermined direction of the third discharge port array are arranged in the intersecting direction to form a second overlap portion for discharging the inks to the same area on the recording medium;

a scanning unit configured to perform relatively scanning in the intersecting direction of the recording head and the recording medium; and a control unit configured to perform control to discharge the ink from the recording head to record a plurality of dots on the recording medium while scanning the recording head by the scanning unit, wherein the control unit controls the discharge of the inks to record dot columns each including a plurality of dots arranged in the predetermined direction on the recording medium so that (i) a shape of a first boundary between an image recorded on the recording medium from the discharge ports in the first overlap portion of the first discharge port array and an image recorded on the recording medium from the discharge ports in the first overlap portion of the second discharge port array continuously varies in the predetermined direction as its position in the intersecting direction changes, and (ii) a shape of a second boundary between an image recorded on the recording medium from the discharge ports in the second overlap portion of the second discharge port array and an image recorded on the recording medium from the discharge ports in the second overlap portion of the third discharge port array continuously varies in the predetermined direction as its position in the intersecting direction changes, and the shape of the second boundary differs from the shape of the first boundary.

20. The recording apparatus according to claim 19, wherein the shape of the first boundary and the shape of the second boundary respectively continuously and periodically vary in the predetermined direction as the positions in the intersecting direction change, to form wave shapes.

21. The recording apparatus according to claim 20, wherein a phase of the wave shape of the second boundary differs from a phase of the wave shape of the first boundary.

22. The recording apparatus according to claim 21, wherein the wave shape of the second boundary is opposite to the phase of the wave shape of the first boundary.

23. The recording apparatus according to claim 20, wherein a period of the wave shape of the second boundary differs from a period of the wave shape of the first boundary.

24. The recording apparatus according to claim 20, wherein an amplitude of the wave shape of the second boundary differs from an amplitude of the wave shape of the first boundary.

25. The recording apparatus according to claim 19, wherein a distance between positions in the two adjacent dot columns in the intersecting direction on the recording medium in the predetermined direction of the first boundaries, and a distance between positions in the predetermined direction of the second boundaries are respectively 120 μm or less.

26. A method for recording an image by relatively scanning with a recording head including at least first, second, and third discharge port arrays each having a plurality of discharge ports for discharging inks having the same color arranged in a predetermined direction, the first, second, and third discharge port arrays being displaced from one another in the predetermined direction so that N number of first discharge ports arranged at an end on the first side in the predetermined direction of the first discharge port array and N number of second discharge ports arranged at an end on the second side opposite to the first side in the predetermined direction of the second discharge port array are arranged in a direction intersecting the predetermined direction to form a first overlap portion for discharging the inks to the same area on the recording medium, and N number of third discharge ports arranged at an end on the first side in the predetermined direction of the second discharge port array and N number of fourth discharge ports arranged at an end on the second side in the predetermined direction of the third discharge port array are arranged in the intersecting direction to form a second overlap portion for discharging the inks to the same area on the recording medium, and the recording medium in the intersecting direction, while discharging the inks to the recording medium from the recording head according to recording ratios respectively determined for the N number of first discharge ports, the N number of second discharge ports, the N number of third discharge ports, and the N number of fourth discharge ports, wherein the discharge of the inks is controlled in each of the pixel columns including a plurality of pixels arranged in the predetermined direction on the recording medium so that (i) the inks are not discharged, among the N number of first discharge ports, from M ($0 \leq M \leq N$) number of discharge ports on the first side in the predetermined direction and are discharged according to the first recording ratio from L ($0 \leq L \leq N-M$) number of discharge ports on the second side in the predetermined direction, (ii) the inks are not discharged, among the N number of second discharge ports, from the L discharge ports on the second side in the predetermined direction and are discharged according to the first recording ratio from the M number of discharge ports on the first side in the predetermined direction, (iii) the inks are not discharged, among the N number of third discharge ports, from K ($0 \leq K \leq N$) number of discharge ports on the first side in the predetermined direction and are discharged according to the second recording ratio from J ($0 \leq J \leq N-K$) number of discharge ports on the second side in the predetermined direction, and (iv) the inks are not discharged, among the N number of fourth discharge ports, from the J number of discharge ports on the second side in the predetermined direction and are discharged according to the second recording ratio from the K number of discharge ports on the first side in the predetermined direction, and wherein respective values in at least one of a first set of the M and the K and a second set of the L and the J continuously increase or decrease as a position of the pixel column in the intersecting direction on the recording medium changes, and the respective values differ from each other when the position of the pixel column in the intersecting direction on the recording medium is a predetermined position.

* * * * *